United States Patent [19]

Miyake

[11] Patent Number: 4,688,956

[45] Date of Patent: Aug. 25, 1987

[54] CARRIAGE FEED CONTROL METHOD FOR BOLD AND SHADOW PRINTING

[75] Inventor: Tomohisa Miyake, Kanagawa, Japan

[73] Assignee: Tokyo Juki Industrial Co. Ltd., Chofu, Japan

[21] Appl. No.: 924,121

[22] PCT Filed: Nov. 21, 1984

[86] PCT No.: PCT/JP84/00556

§ 371 Date: Jul. 10, 1985

§ 102(e) Date: Jul. 10, 1985

[87] PCT Pub. No.: WO85/02372

PCT Pub. Date: Jun. 6, 1985

Related U.S. Application Data

[63] Continuation of Ser. No. 758,229, Jul. 10, 1985, abandoned.

[30] Foreign Application Priority Data

Nov. 25, 1983 [JP] Japan ..... 58-221557

[51] Int. Cl.[4] ..... B41J 19/58

[52] U.S. Cl. ..... 400/304; 400/279; 400/299; 400/320; 400/322

[58] Field of Search ..... 400/279, 299, 303, 304, 400/320, 322

[56] References Cited

U.S. PATENT DOCUMENTS

| | | | |
|---|---|---|---|
| 4,493,570 | 1/1985 | Araki | 400/279 |
| 4,502,800 | 3/1985 | Jamieson et al. | 400/322 |

FOREIGN PATENT DOCUMENTS

| | | | |
|---|---|---|---|
| 56-63675 | 5/1981 | Japan | 400/304 |
| 58-14755 | 1/1983 | Japan | 400/304 |
| 58-29678 | 2/1983 | Japan | 400/304 |
| 58-71168 | 4/1983 | Japan | 400/304 |
| 58-63483 | 4/1983 | Japan . | |
| 58-76279 | 5/1983 | Japan . | |
| 58-102779 | 6/1983 | Japan | 400/304 |

OTHER PUBLICATIONS

"Bold Image Typing"; C. G. Brown; *IBM Technical Disclosure Bulletin;* vol. 20, No. 9, pp. 3555–3556; Feb. 1978.

*Primary Examiner*—Edgar S. Burr
*Assistant Examiner*—David A. Wiecking
*Attorney, Agent, or Firm*—Tarolli, Sundheim & Covell

[57] ABSTRACT

Inaccurate duplication of the first and the secnd prints due to the inequality of the distance and arrangement therebetween occurs in a serial printer in which a carriage is moved parallel to a platen by a servo motor etc. The first printing in duplex printing is performed after sufficient time for damping of the oscillation of the carriage in this invention. The second printing is done after sufficient time for damping of the oscillation as well as before. The control may be performed by sensing the necessary carriage displacement. The duplex printing may be performed when the displacement is zero or a small value.

2 Claims, 13 Drawing Figures

CARRIAGE FEED CONTROL METHOD FOR BOLD AND SHADOW PRINTING

This is a continuation of co-pending application Ser. No. 758,229 filed on July 10, 1985, now abandoned.

TECHNICAL FIELD

The present invention relates to a serial printer in which a carriage is moved by a stepping motor or servo motor parallel to a platen, and more particularly to a printing control system for such a printer to enable duplex printing.

BACKGROUND ART

Conventionally, in a serial printer which actuates a printing means after the carriage is displaced and stopped, printing can be performed based on the letter data of one line and feed data between the letters.

For example, the printing data for "I am" consists of letter data "I", space data, space data, letter data "a", space data, and letter data "m".

As shown, printing is performed after a space data command, i.e. displacement of the carriage. However, as the carriage has inertia, damped oscillation is produced after stopping instant S of the drive means, in the form of a stepping motor, of the carriage, as shown in FIG. 1. The oscillation of the carriage is damped sufficiently by waiting a long settling time $T_1$ after the timing S. Thus, when printing is performed after waiting this long settling time, the printing position is correct. As the time $T_1$ is long, printing is ordinarily performed after a time $T_0$ which is shorter than the time $T_1$ and some deviation in the printing position is ignored. Thus, the printing speed is increased.

In such a system, problems are produced in bold print which prints the same letter by space data zero shown in FIG. 3B and in shadow print which prints the same letter by very small space data shown in FIG. 4B. In bold print, as shown in FIG. 1, first printing is performed at timing $A_1$ after the instant S during which the drive means stops, and the second printing is performed at timing $A_2$ which is time $T_1$ after the timing S. Thus, the print position of the second printing is accurate as the timing $A_2$ is sufficiently long with respect to the damped oscillation of the carriage.

In the shadow print, first printing is performed at timing $B_1$ shown in FIG. 2, after time $T_0$ from drive means stopping instant S, and the carriage is displaced by the necessary pitch P. Then after long settling mode time $T_2$ which is sufficiently long for the oscillation of the carriage to be damped, second printing is performed at timing $B_2$.

In these cases of bold print and shadow print, the second print positions are obtained accurately in the proper positions.

However, the first timing $A_1$, $B_1$ of the first printing is the ordinary printing timing, i.e., after time $T_0$ from S, so that, as shown in FIGS. 1 and 2, the first printing position deviates by the dimension $\Delta P$ from its proper position D. Thus, the second print position is accurately in alignment with the proper position, but, nevertheless, as shown in FIG. 3C, the printed bold print is not duplexed properly and the first and second prints deviate by $\Delta P$ from each other. Also, in the shadow print, as shown in FIG. 4C, the first and second prints vary by a distance $P_1$ which is vider than the intended pitch P or by a distance narrower than the intended pitch P.

Therefore, they have had this fault to lead to the printing of unbecoming letters.

SUMMARY OF THE INVENTION

The object of the present invention is to eliminate the above-mentioned disadvantage.

The printing control method for a printer in this invention includes the duplex printing of bold prints and shadow prints precisely by controlling the first printing thereof such that it is effected only after sufficient damping of the carriage oscillation has taken place.

BEST MODE FOR CARRYING OUT THE INVENTION

Figure 5:
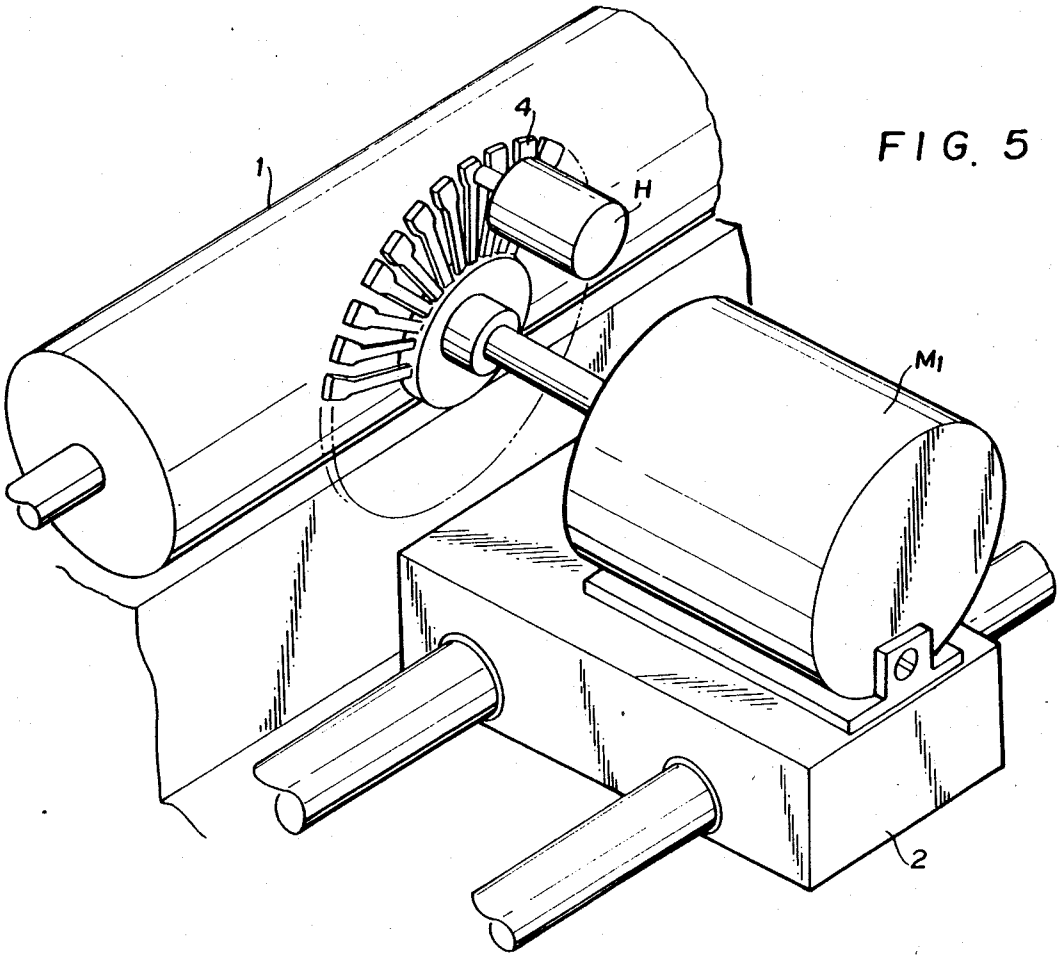
FIG. 5 is a schematic perspective view of a printer.

Referring now to FIG. 5, a serial printer has a platen 1 and a carriage 2 supported by a frame and adapted to be displaceable parallel to the platen 1. The carriage 2 is connected with a stepping motor $M_2$ and is able to be displaced and stepped by the electric control of the stepping motor $M_2$. Such construction is described in Japanese Patent Laid Open Application No. 22190/1983.

A type select stepping motor $M_1$ is mounted on the carriage 2. The end of a drive shaft 3 of the stepping motor $M_1$ releasably supports a daisy wheel type body 4.

A printing hammer H is secured to the carriage 2 upwards of the stepping motor $M_1$. The hammer H is adapted to print a letter by urging an opposed type onto the platen 1 upon actuation by an electric signal.

Figure 6:
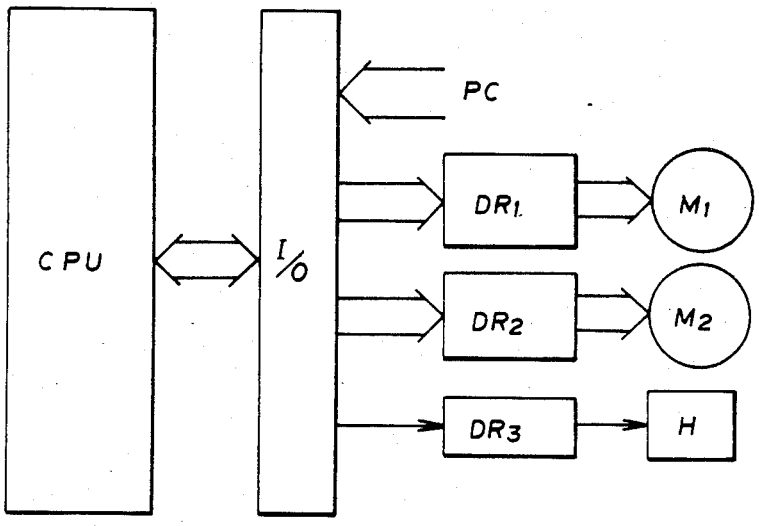
FIG. 6 is a block diagram of a control circuit according to the present invention.

FIG. 6 shows a control circuit for controlling the serial printer. In FIG. 6, the control circuit includes a central process unit CPU which has a computer and input/output function, a drive circuit $DR_1$ for the type select stepping motor $M_1$, a drive circuit $DR_2$ for the carriage displacement stepping motor $M_2$, and an energizing circuit $DR_3$ for the printing hammer H. In FIG. 6, PC designates control commands from a host computer, not shown, including printing commands for duplex printing and normal printing, space command and next line commands. Interface I/O is connected between the central process unit CPU and the host computer and drive circuits $DR_1$–$DR_3$.

Figure 7:
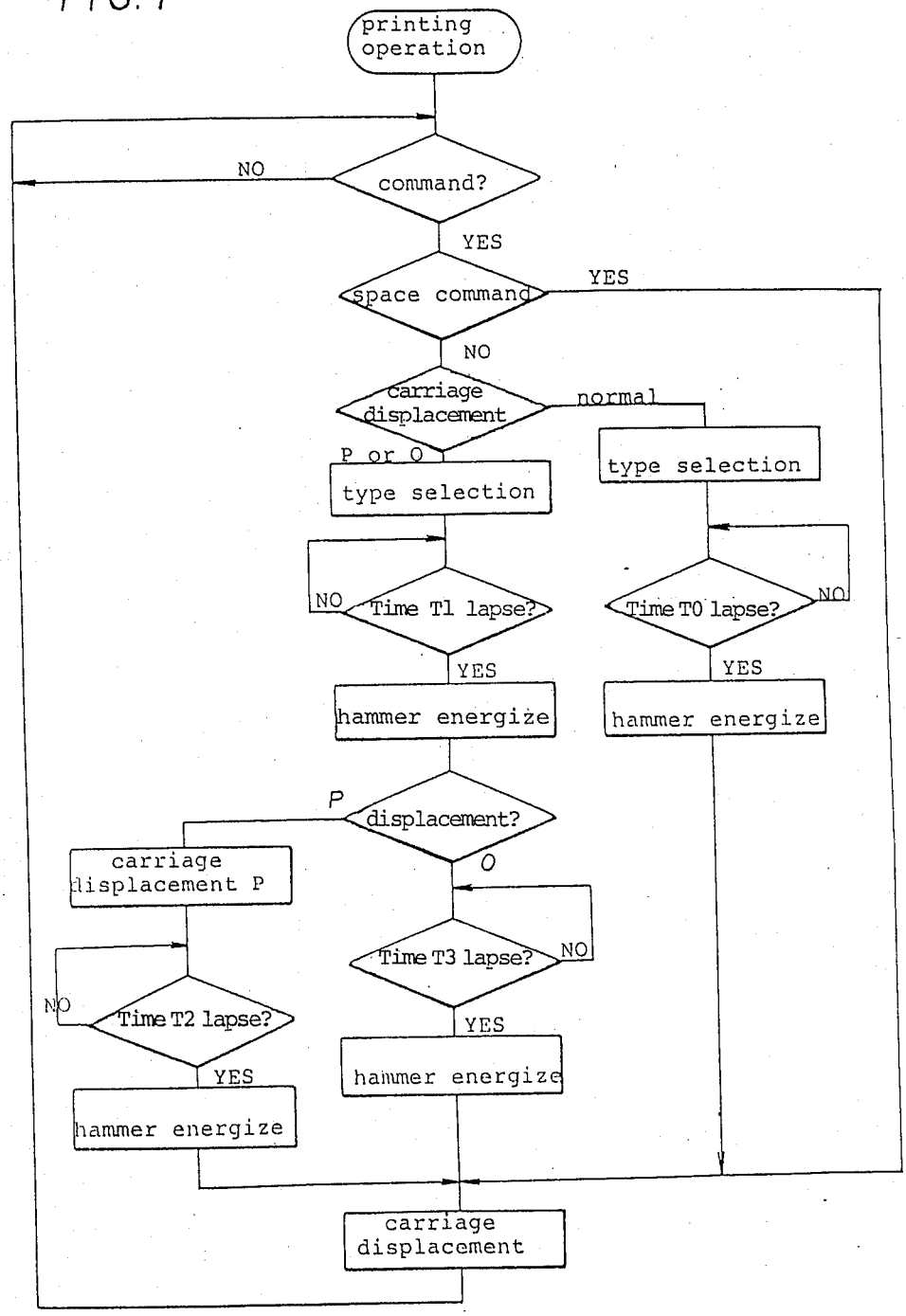
FIG. 7 is a control flow chart of the central process unit shown in FIG. 6.

FIG. 7 shows a flow chart of a printing operation control program of the central process unit CPU. The flow chart normally waits for a command PC from the host computer. When the command PC is accepted, the program judges whether the command is a space command or not. When the command is a space command, the carriage is displaced by the width of one letter and waits for the next command. When the command is a printing command, judgement is made as to the next carriage displacement after the printing. When the displacement is a normal space, the stepping motor $M_1$ is driven to select the necessary type. Then the printing hammer H is energized after a time interval $T_0$ from the stoppage of the carriage 2. After the printing, the carriage 2 is displaced by a normal one letter width.

Figure 1:
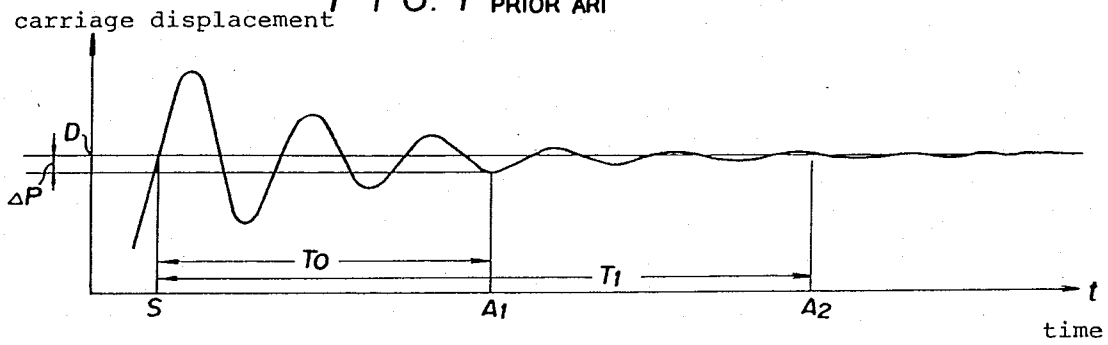
FIG. 1 PRIOR ART
FIG. 1 is a time chart for the printing of bold printing in a conventional printer.
Figure 2:
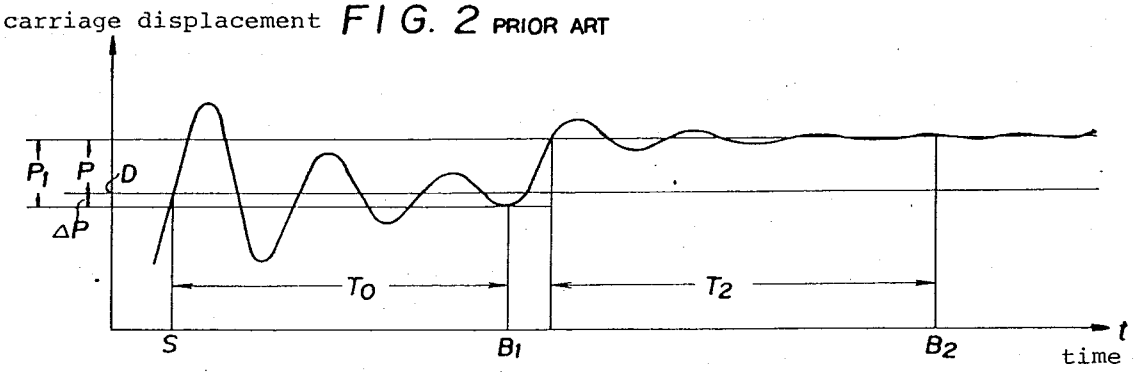
FIG. 2 PRIOR ART
FIG. 2 is a time chart for the printing of shadow printing in a conventional printer.
Figure 8:
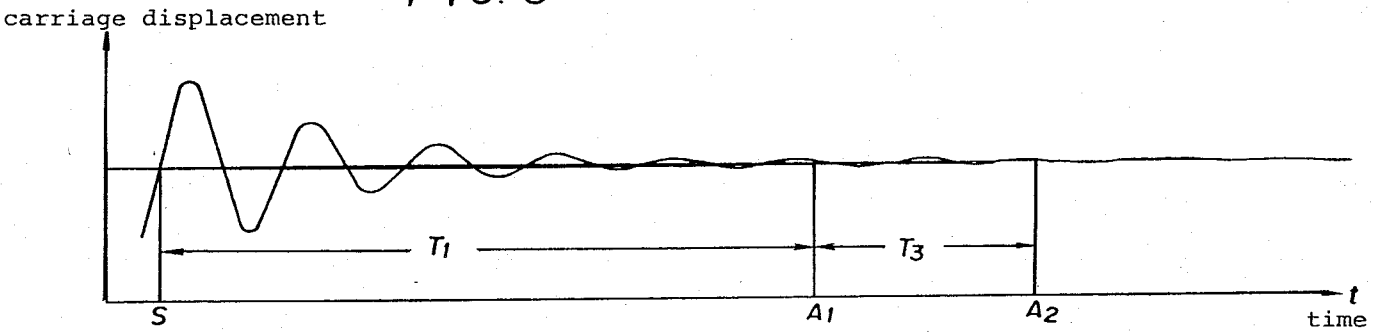
FIG. 8 is a time chart for the printing of bold printing in the printer according to the present invention.
Figure 9:
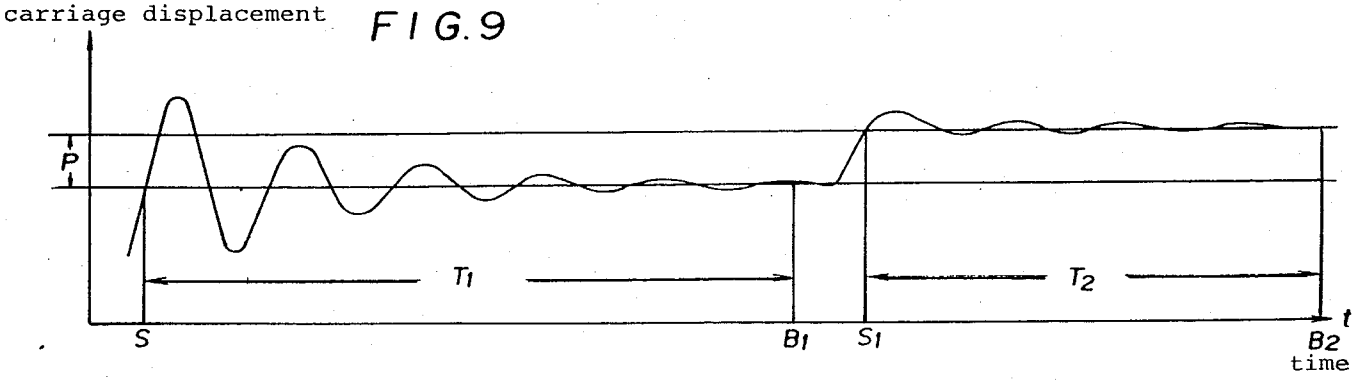
FIG. 9 is a time chart for the printing of shadow printing in the printer according to the present invention.

If the next carriage displacement is abnormal, i.e. "O" or "P" corresponding to the bold or shadow print, respectively, shown in FIG. 9, the type is selected by the driving of the stepping motor $M_1$, and the printing operation is performed by energizing the printing hammer, after elapse of long settling mode interval $T_1$ which is greater than $T_0$ as shown in FIG. 1 after the stoppage S of the carriage 2. Next judgement is made as to whether the carriage 2 displacement is "O" or "P". If "O", the printing hammer H is energized after elapse of time $T_3$ shown in FIG. 8, allowing for vibration dampening of the carriage 2 caused by the printing operation of the hammer H. If "P", the carriage 2 is displaced by the pitch P, and the hammer H is energized after lapse of time $T_2$ shown in FIGS. 2 and 9, allowing for sufficient vibration dampening of the carriage 2.

Thus, after the completion of double printing, the carriage 2 is displaced by one letter width and the control circuit waits for the next command.

The operation of the serial printer will now be described.

First, when a space command is applied from the host computer to the central process unit CPU, the stepping motor $M_2$ is driven. The carriage 2 is displaced by one letter width and stops. The carriage 2 produces dampened oscillation as shown in FIG. 1. Next, a normal printing mode command is applied from the host computer to the central process unit CPU, whereupon the stepping motor $M_1$ turns to select a predetermined letter from the type body 4. The printing hammer H is energized after elapse of time $T_0$ from the stoppage of the stepping motor $M_2$. A type of the type body 4 is printed on the platen 1.

When the printing is completed, the stepping motor $M_2$ is driven to displace the carriage 2 by one letter width.

Figure 3A:
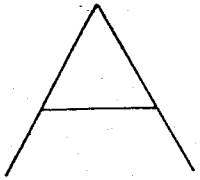
FIG. 3A PRIOR ART
FIGS. 3A–3C are images of bold print.
Figure 3B:
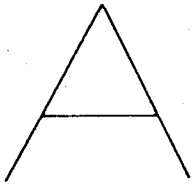
FIG. 3B PRIOR ART
Figure 3C:
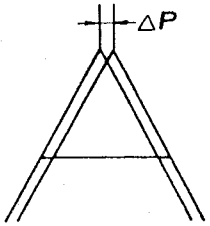
FIG. 3C PRIOR ART

Next, when a bold print printing command, i.e. duplex printing without displacement of the carriage, is applied from the host computer to the central process unit, the stepping motor $M_1$ turns the type body 4 to select a desired letter (for instance, letter "A"). As the printing is in the duplex printing mode, not the normal printing mode, the printing hammer H is energized to print the letter (FIG. 3A) at timing $A_1$ which follows lapse of time $T_1$ shown in FIG. 8 after the stoppage instant S of the stepping motor $M_2$ for driving the carriage 2. The time $T_1$ is sufficiently long to damp the oscillation of the carriage 2. The printing hammer H is energized again at timing $A_2$ following lapse of time $T_3$ from the printing instant $A_1$. The time $T_3$ is sufficiently long to damp the vibration of the carriage 2 caused by the printing operation of the hammer H. Thus a printed image is obtained such as is shown in FIG. 3B wherein the second printing "A" precisely coincides with the first printing.

Then, the stepping motor $M_2$ is driven to displace the carriage 2 by one letter width.

Figure 4A:
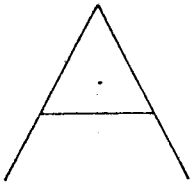
FIG. 4A PRIOR ART
FIGS. 4A–4C are images of shadow print.
Figure 4B:
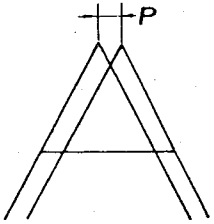
FIG. 4B PRIOR ART
Figure 4C:
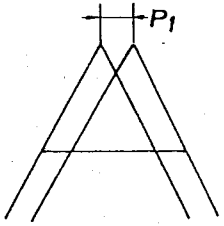
FIG. 4C PRIOR ART

When shadow print printing command to select the interval "P" for the next print is applied from the host computer, the stepping motor $M_1$ turns to select a predetermined letter, e.g. "A" in the type body 4. As such printing is also in the multiplex printing mode, the printing hammer H is energized at timing $B_1$ shown in FIG. 9. The printed image is shown in FIG. 4A. The timing $B_1$ follows elapse of time $T_1$ from instant S of the stoppage of the stepping motor $M_2$ for driving the carriage 2. The time $T_1$ is sufficiently long to damp the oscillation of the carriage 2. After the first printing, the carriage 2 is displaced by a distance P by the stepping motor $M_2$. The carriage 2 is stopped at timing $S_1$. After the instant $S_1$ at timing $B_2$ which is time $T_2$ from the timing $S_1$ and is sufficiently long to damp the oscillation of the carriage caused by the stoppage of the carriage 2, the printing hammer H is energized. The printed image is shown in FIG. 4B. As shown, the second printing is displaced from the first printing by the dimension P.

As described in detail, the printer according to the present invention provides a microcomputer which determines whether the next printing is to be duplex printing or not. To perform duplex printing, the first and the second printing are both performed after a lapse of a sufficiently long time from the stoppage of the carriage for the oscillation of the carriage to be damped. Thus, a printing position is set precisely and desired duplex printing can be obtained.

In the above-mentioned embodiment, a stepping motor is used to drive the carriage. A servo motor or linear motor may be used in place of a stepping motor.

In the above-mentioned embodiment, the printing command is applied from the host computer. A serial printer having a keyboard input may also be used in the present invention. That is, a plurality of printing commands from the keyboard may be stored in a buffer register, and printing may be performed by reading the printing commands in the buffer register. In such a case, the flow chart shown in FIG. 7 can be used to control the printing process.

In the flow chart shown in FIG. 7, bold print or shadow print is determined by the carriage displacement after the ensuing printing. The printing command may include data which commands bold printing or shadow printing, and the central process unit may read the data for determining either bold or shadow printing.

INDUSTRIAL APPLICABILITY

Inaccurate duplication of the first and the second prints due to the inequality of the distance and arrangement therebetween is dissolved by this invention. The reading of the program is applicable to this invention by those ordinarily skilled in the art.

I claim:

1. A printer control method for a printer including a carriage supported by a frame for movement parallel to a platen, a type head mounted on the carriage and adjacent to the platen and capable of selecting a letter to be printed with electric control, a printing hammer mounted on the carriage for printing the type head on the platen with electric control, carriage drive means connected with the carriage for displacing by discrete amounts the carriage with electric control, and control means for selecting and printing a predetermined letter and displacing the carriage upon receipt of a printing command which includes the letter to be printed and the subsequent displacement of the carriage, the printing command including a normal printing mode in which the carriage drive means is actuated after printing a letter to displace the carriage by more; than one letter width and a bold printing mode in which the carriage drive means is not actuated after printing a letter, said printer control method including the steps of:

waiting for a printing command from a CPU;

determining the carriage displacement which follows the printing to determine whether the displacement is for the normal printing mode or the bold printing mode;

during the normal printing mode, actuating the printing hammer at a first predetermined time after the stoppage of the carriage drive means;

during the bold printing mode, actuating the printing hammer to make a first printing after a second predetermined time lapse after the stoppage of the carriage drive means, said second predetermined time being; longer than said first predetermined time and being sufficient long for an oscillation of the carriage to be damped after the stoppage of the carriage drive means, then actuating the printing hammer to make a second printing for bold printing after a third predetermined time lapse which is sufficiently long for damping the vibration of the carriage caused by the first printing of the hammer; and displacing the carriage by more than one letter width.

2. A printer control method for a printer including a carriage supported by a frame and for movement parallel to a platen, a type head mounted on the carriage and adjacent to the platen and capable of selecting a letter to be printed with electric control, a printing hammer mounted on the carriage for printing the type head on the platen with electric control, carriage drive means connected with the carriage for displacing by descrete amounts the carriage with electric control, and control means for selecting and printing a predetermined letter and displacing the carriage upon receipt of a printing command which includes the letter to be printed and the subsequent displacement of the carriage, the printing command including a normal printing mode in which the carriage drive means is actuated after an ensuing printing to displace the carriage by more than one letter width and a shadow printing mode in which the carriage drive means is actuated after an ensuing printing to displace the carriage by less than one letter width, said printing control method including the steps of:

waiting for a printing command from a CPU;

determining the carriage displacement for the printing to determine whether the displacement is for the normal printing mode or the shadow printing mode;

during the normal printing mode, actuating the printing hammer at a first predetermined time after the stoppage of the carriage drive means;

during the shadow printing mode, actuating the printing hammer to make a first printing after a second predetermined time lapse after the stoppage of the carriage drive means, said second predetermined time being longer than said first predetermined time and being sufficiently long for the oscillation of the carriage to be damped after the stoppage of said carriage drive means then displacing the carriage by less than one letter width and actuating the printing hammer to make a second printing for shadow printing after a third predetermined time lapse which is sufficiently long for damping the vibration of the carriage caused by said displacing of the carriage by less than one letter width; and displacing the carriage by more than one letter width.

* * * * *